US005675994A

United States Patent [19]

Gweon

[11] Patent Number: 5,675,994

[45] Date of Patent: Oct. 14, 1997

[54] DETERGENT DISSOLUTION DEVICE OF A CLOTHES WASHING MACHINE

[75] Inventor: Tae Soung Gweon, Suwon, Rep. of Korea

[73] Assignee: Samsung Electronics Co., Ltd., Suwon, Rep. of Korea

[21] Appl. No.: 638,150

[22] Filed: Apr. 26, 1996

[30] Foreign Application Priority Data

Jun. 14, 1995 [KR] Rep. of Korea ..... 1995-15703

[51] Int. Cl.[6] ..... D06F 39/02

[52] U.S. Cl. ..... 68/17 R

[58] Field of Search ..... 68/17 R; 134/93; 422/266; 137/268; 222/153.04, 325

[56] References Cited

U.S. PATENT DOCUMENTS 5,473,914 12/1995 Pyo et al. ..... 68/17 R

FOREIGN PATENT DOCUMENTS 0410086 1/1991 European Pat. Off. ..... 68/17 R 0465800 1/1992 European Pat. Off. ..... 68/17 R 2126240 8/1972 Germany ..... 68/17 R 3403622 8/1985 Germany ..... 68/17 R

*Primary Examiner*—Philip R. Coe

*Attorney, Agent, or Firm*—Burns, Doane, Swecker & Mathis, L.L.P.

[57] ABSTRACT

A clothes washing machine includes a detergent dissolving assembly comprised of an outer casing mounted in a housing of the machine, and an inner casing mounted in the outer casing so as to be slidable in and out with respect thereto. The inner casing includes a detergent receptacle for receiving powdered detergent which is to become dissolved by inflowing wash water. The inner casing is automatically locked to the outer casing upon being pushed thereinto. To access the inner casing, an inward push is applied thereto, whereupon the inner casing becomes automatically unlocked from the outer casing and displaced outwardly to a detergent-receiving position by a spring. A speed damper is provided for damping the speed of travel of the inner casing.

14 Claims, 10 Drawing Sheets

FIG. 8
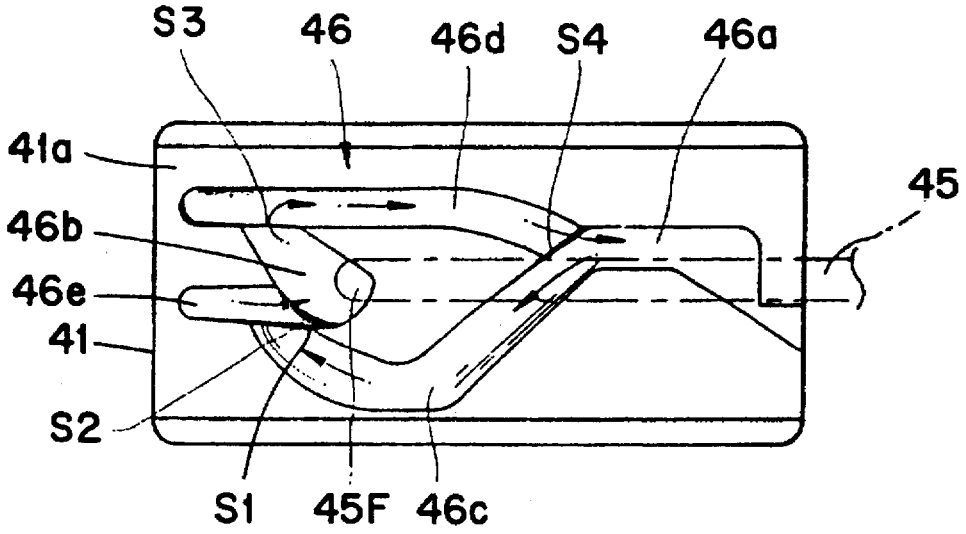
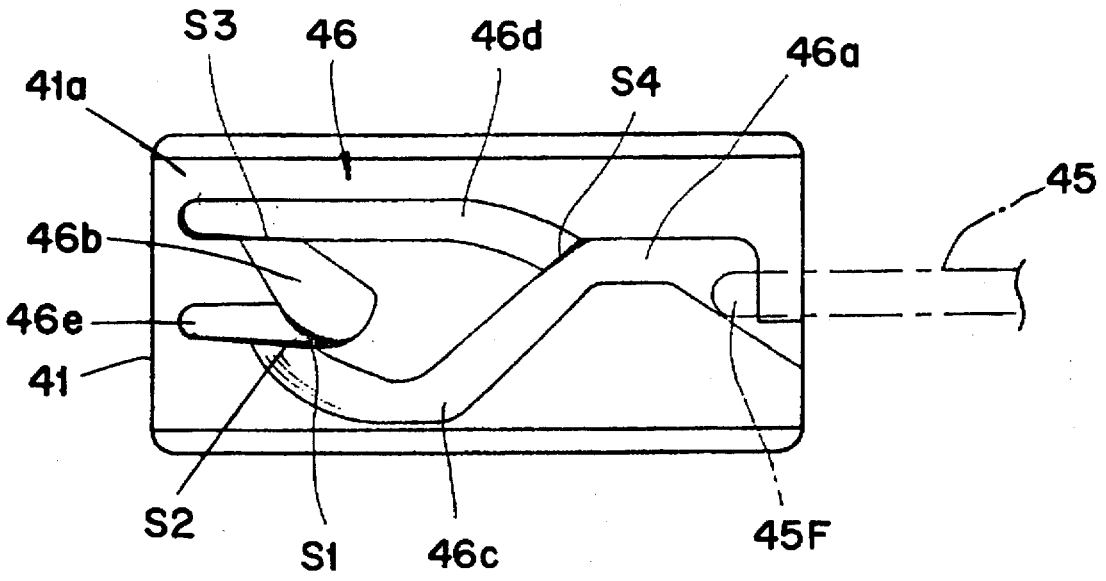
FIG. 9

FIG. 13
(PRIOR ART)
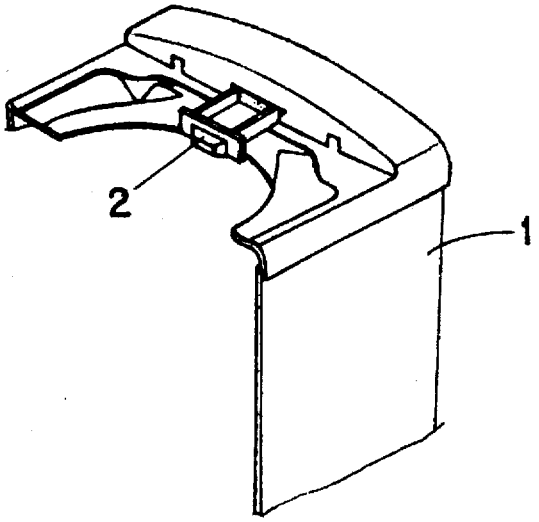
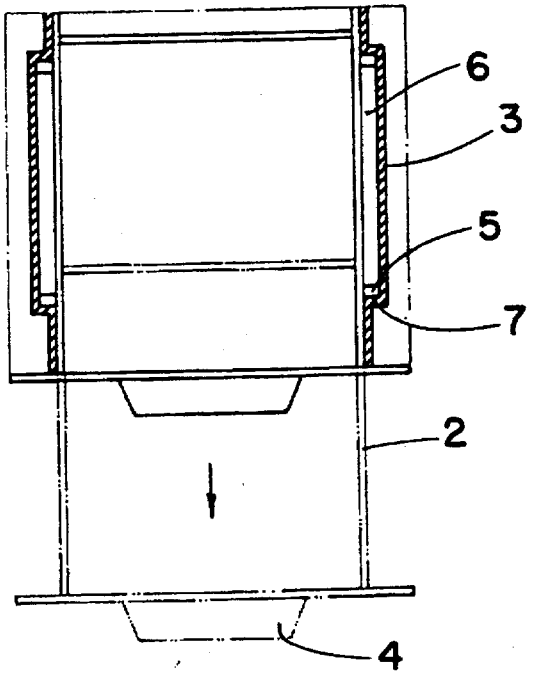
FIG. 14
(PRIOR ART)

DETERGENT DISSOLUTION DEVICE OF A CLOTHES WASHING MACHINE

TECHNICAL BACKGROUND

The present invention concerns a detergent dissolution device of a washing machine which comprises a detergent receptacle for containing a detergent and a casing for receiving the detergent receptacle.

Conventionally, the detergent is put into the water of a washing basket together with clothes when the clothes washing machine starts a washing operation. Alternatively, a detergent dissolution device can be provided in the upper part of the washing machine to automatically dissolve a powdered detergent with the help of supplied water and to put the dissolved detergent into the washing basket.

FIG. 13 schematically illustrates such a conventional detergent dissolution device, which includes, as shown in FIG. 14, a detergent receptacle 2 retractably mounted in the upper part of the housing 1 of a washing machine for containing a detergent, and a casing 3 fixedly attached in the upper part of the housing 1 for receiving the detergent receptacle 2. The detergent receptacle 2 has a handle at the front surface, and projections 5 at the side surfaces for limiting the retracting motion. The casing 3 is provided with a pair of guide grooves 6, which have stops at their respective front ends to obstruct the projections 5 when retracting the detergent receptacle 2, as typically shown in U.S. patent application Ser. No. 08/399,148 (filed on Mar. 6, 1995).

When it is required to refill the detergent receptacle, the detergent receptacle must be firstly pulled out manually, and pushed into the casing again manually after being refilled, thereby causing inconvenience to a user. Particularly, as the detergent dissolution device is mounted at the rear side of the upper part of the washing machine for the detergent to be automatically dissolved in the water supplied through a water supply pipe, it becomes more difficult to manually work the detergent dissolution device. In addition, when the detergent receptacle and casing are too firmly connected, unnecessarily strong force must be applied to pull out the detergent receptacle, so that the detergent receptacle may be separated from the casing broken.

SUMMARY OF THE INVENTION

It is an object of the present invention to provide a detergent dissolution device of a clothes washing machine which facilitates the retraction and insertion of the detergent receptacle.

It is another object of the present invention to provide a detergent dissolution device of a clothes washing machine in which automatic retraction of the detergent is possible.

It is still another object of the present invention to provide a detergent dissolution of a clothes washing machine which damps the retraction speed of the detergent receptacle so as to prevent the detergent receptacle from being separated from the casing.

It is further another object of the present invention to provide a detergent dissolution device wherein the cover of the detergent receptacle automatically opens and closes respectively according to the retraction and insertion of the detergent receptacle.

According to an embodiment of the present invention, a detergent dissolution device of a clothes washing machine comprises an outer casing mounted at the upper part of the housing of a clothes washing machine so as to receive the water supplied to a washing basket, an inner casing mounted in the outer casing so as to slidably move in a direction of retraction and insertion, a detergent receptacle included in the inner casing for containing a detergent to be dissolved in the water, a locking means for interlocking or releasing the inner and outer casings relative to each other according to a given force applied to the inner casing, and an automatic retraction means for automatically retracting the inner casing upon a releasing of the locking means.

The present invention will now be described more specifically with reference to the drawings attached only by way of example.

BRIEF DESCRIPTION OF THE ATTACHED DRAWINGS

FIG. 8 is a cross sectional view of a locking pin taken along line 8—8 of FIG. 6;

FIG. 9 is a cross sectional view of the locking pin taken along line 9—9 of FIG. 7;

FIG. 13 is a perspective view for illustrating a conventional detergent dissolution device mounted in a clothes washing machine; and FIG. 14 is a cross sectional view for illustrating the conventional detergent dissolution device inserted into the casing provided in a clothes washing machine.

DETAILED DESCRIPTION OF PREFERRED EMBODIMENTS

Figure 1:
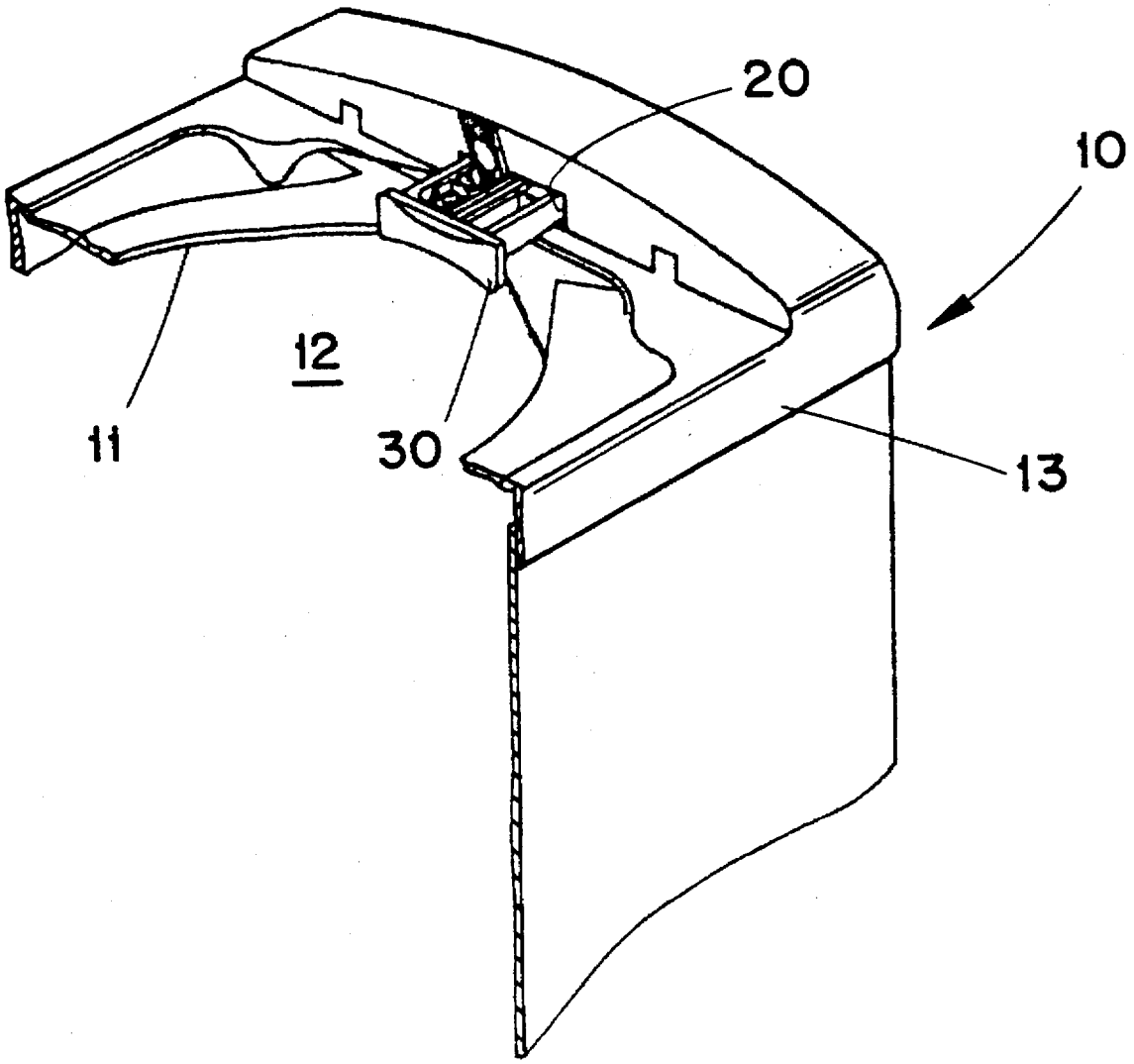
FIG. 1 is an exploded perspective view for illustrating a detergent dissolution device mounted in a clothes washing machine according to an embodiment of the present invention.

Referring to FIG. 1, the housing 10 of a clothes washing machine includes a washing basket 11, and is provided with an upper cover 13 having an opening 12 for enabling clothes to be placed into the washing basket 11. A detergent dissolution device is mounted on the upper cover 13, including an outer casing 20 fixedly attached to the upper cover 13 and an inner casing 30 retractably mounted in the outer casing 20. The water supplied to the washing basket 11 passes through the detergent dissolution device.

Figure 2:
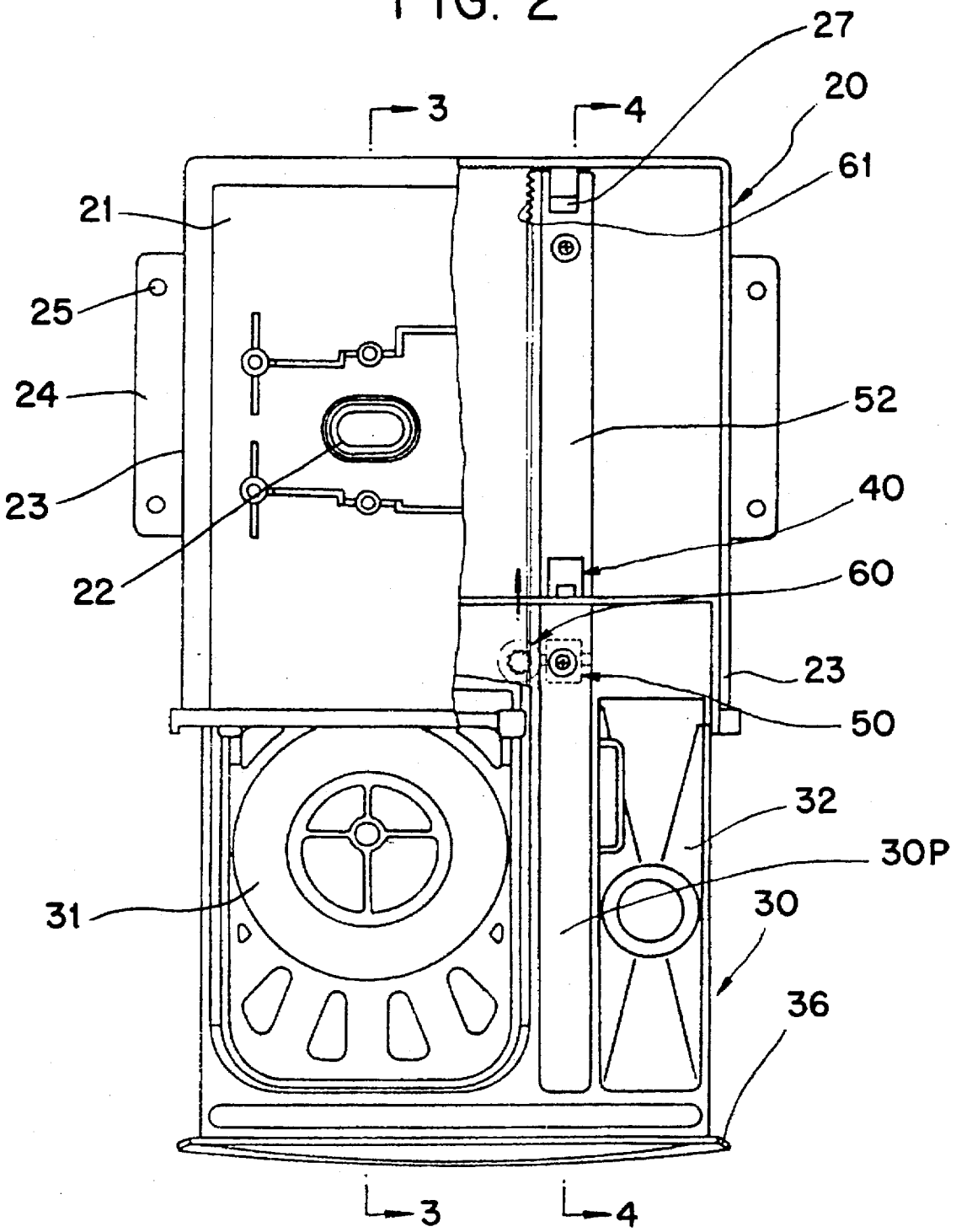
FIG. 2 is a plan view of the inventive detergent dissolution device partly cut away.

The outer casing 20 has its front end opened and its upper surface 21 provided with a water inlet 22 for guiding the water supplied from a water cock, as shown in FIG. 2. At both sides 23 of the outer casing 20 there is provided a fixing flange 24 to attach the outer casing 20 to the upper cover 13 by means of screws penetrating holes 25.

Figure 3:
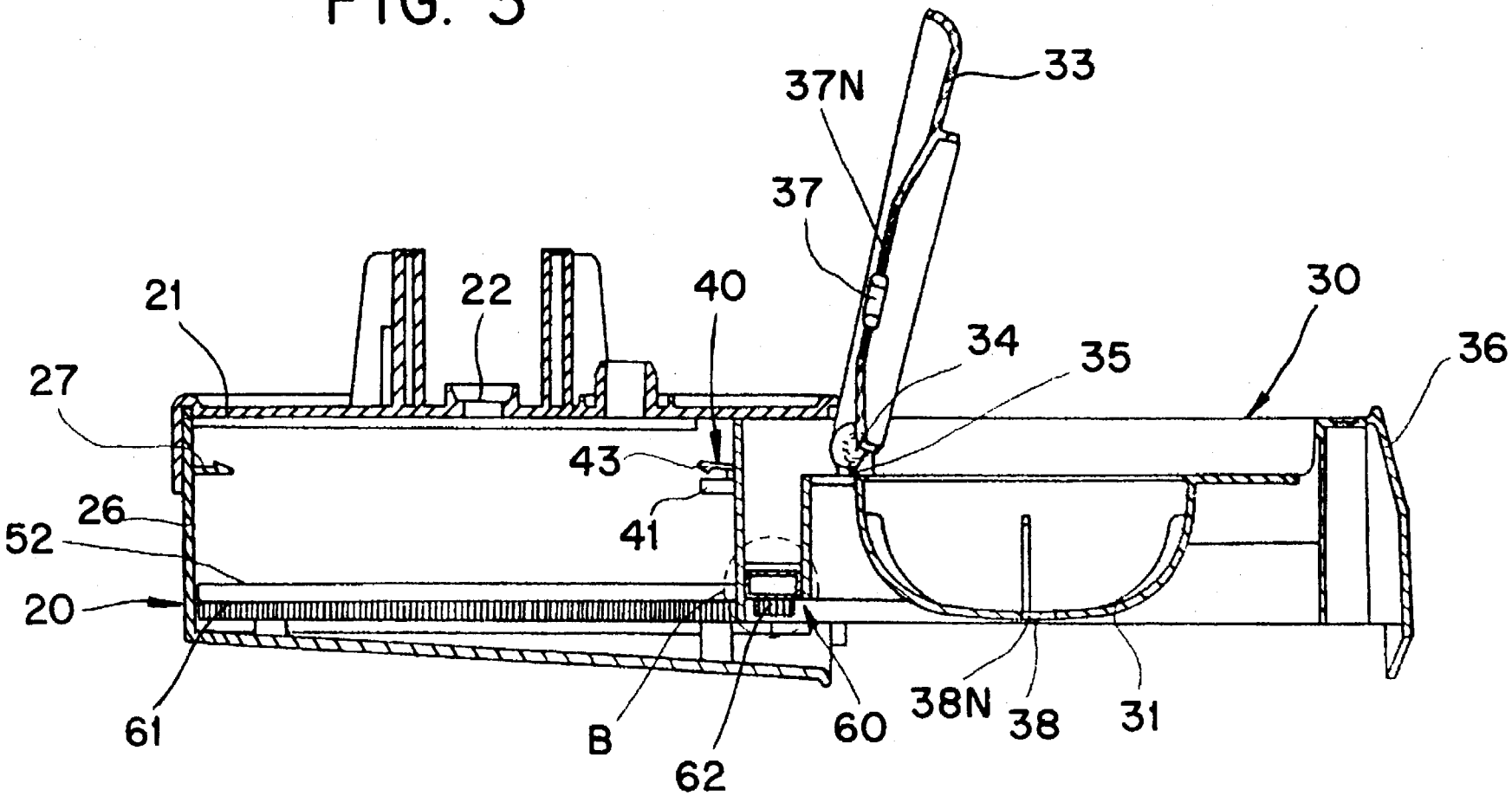
FIG. 3 is a cross sectional view taken along line 3—3 in FIG. 2.

The inner casing 30 is shaped like a box retractably inserted into the outer casing 20. When the inner casing 30 is inserted into the outer housing 20, the front end surface 36 of the inner casing is arranged almost in line with the inside of the upper cover 13. Of course, when the inner casing 30 is retracted, the front end surface is projected into the opening 12. The inner casing 30 includes a detergent receptacle 31 for containing a powdered detergent and a rinse receptacle 32 for containing a rinse agent isolated from the detergent receptacle by means of a partition 30*p*. As shown in FIGS. 2 and 3, the upper end of the detergent receptacle 31 is opened or closed by means of a cover 33, which is connected to the inner casing 30 by means of a hinge structure 34 provided with a torsion spring 35 so that the outer cover 33 is opened by the resilient force of the spring 35 upon the retraction of the inner casing out of the outer casing. The cover 33 is pushed downward by the upper part 21 of the outer casing 20 to cover the detergent receptacle 31 upon the insertion of the inner casing 30 into the outer casing 20. The cover 33 is provided with a water inlet 37 while the bottom of the detergent receptacle 31 is provided with an outlet 38. Provided around the water inlet 37 is a net structure 37N, and the outlet 38 is also formed of a net structure 38N, so that the dissolved detergent is discharged from the detergent receptacle 31 through the net structure 37N into the outer casing 20 and then into the washing basket 11.

Figure 4:
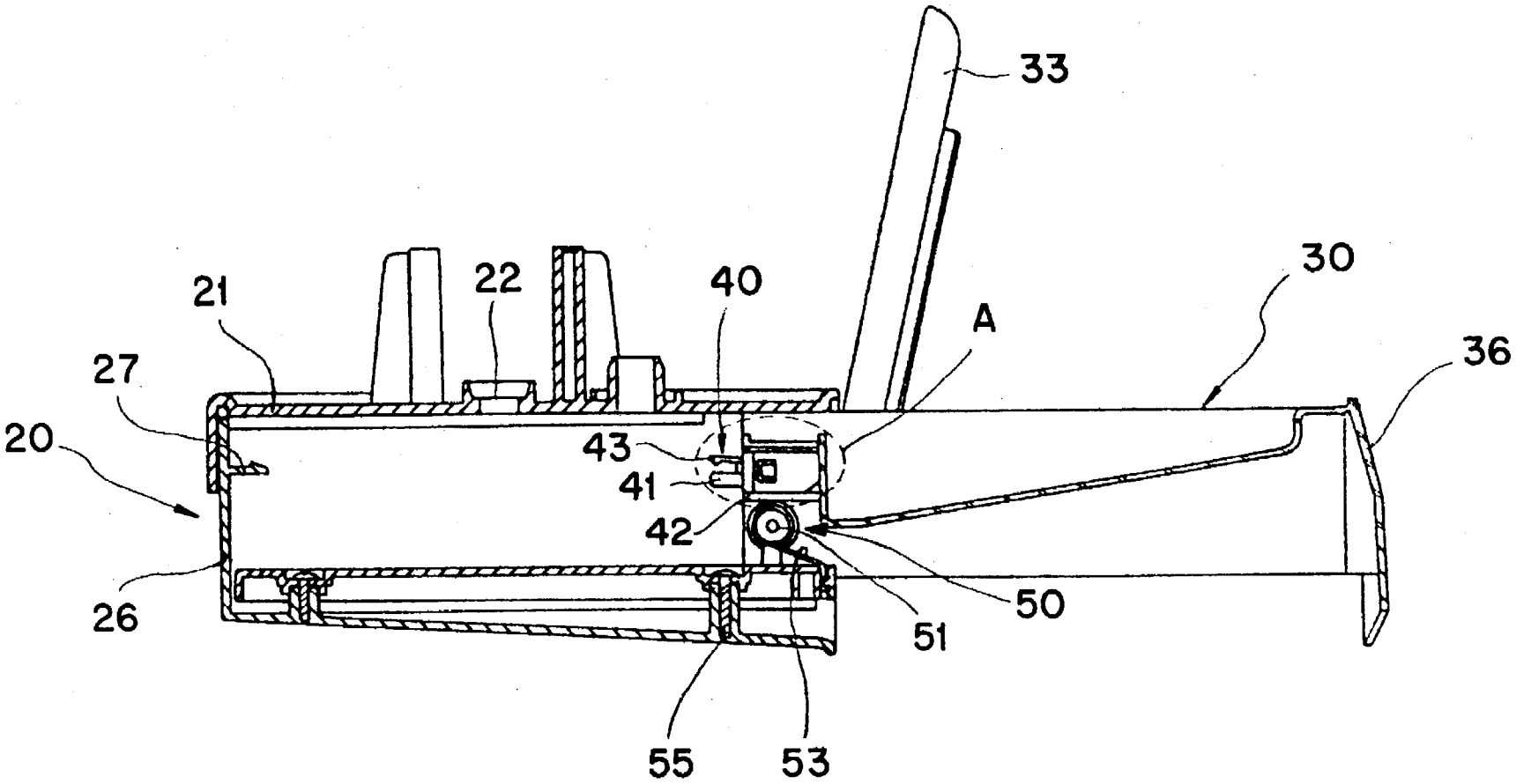
FIG. 4 is a cross sectional view taken along line 4—4 of FIG. 2.
Figure 6:
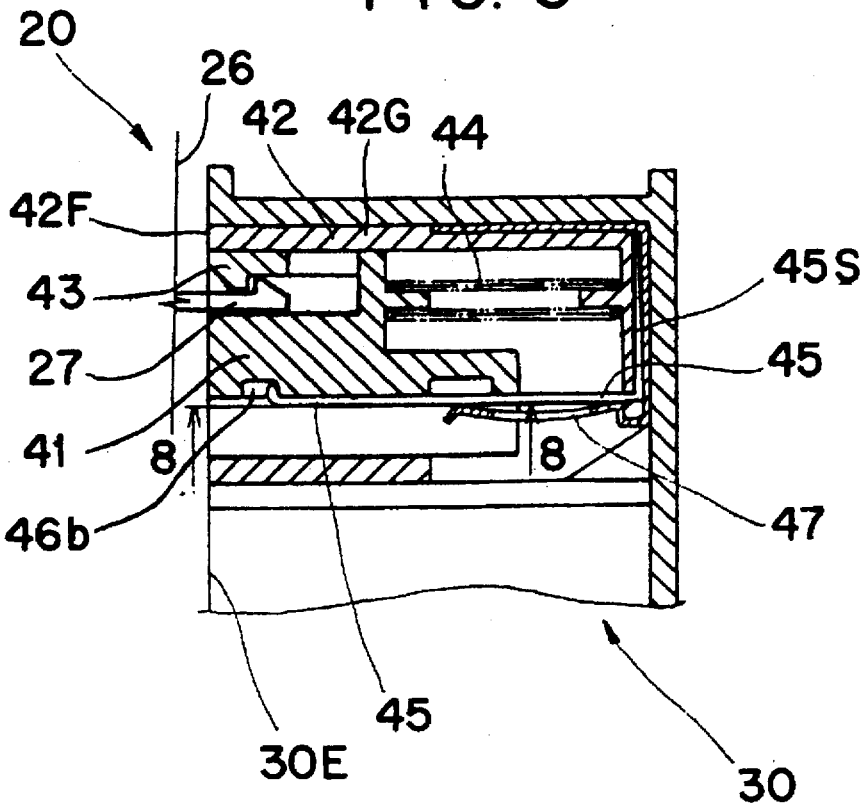
FIG. 6 is an enlarged cross sectional view for illustrating the locked state of the locking means indicated by circle "A" in FIG. 4.

The inner casing 30 is locked to or released from the outer casing 20 by means of a locking device 40 as applying a force to the front end 36, which locking device 40 is hereinafter described with reference to FIGS. 3 and 4. A hook 27 is provided on the inside surface 26 of the rear part of the outer casing 20. The rear part of a body of the inner casing 30 has a recess for receiving a catch housing 42 the latter forming a recess for receiving a catch member 41, which catch housing 42 is provided at the portion of the rear part of the inner casing 30 facing towards the hook 27. The catch housing 42 is inserted into the inner casing 30 so that the front end 42F thereof is arranged substantially in line with the rear end surface 30E of the inner casing 30, as shown in FIG. 6.

Figure 7:
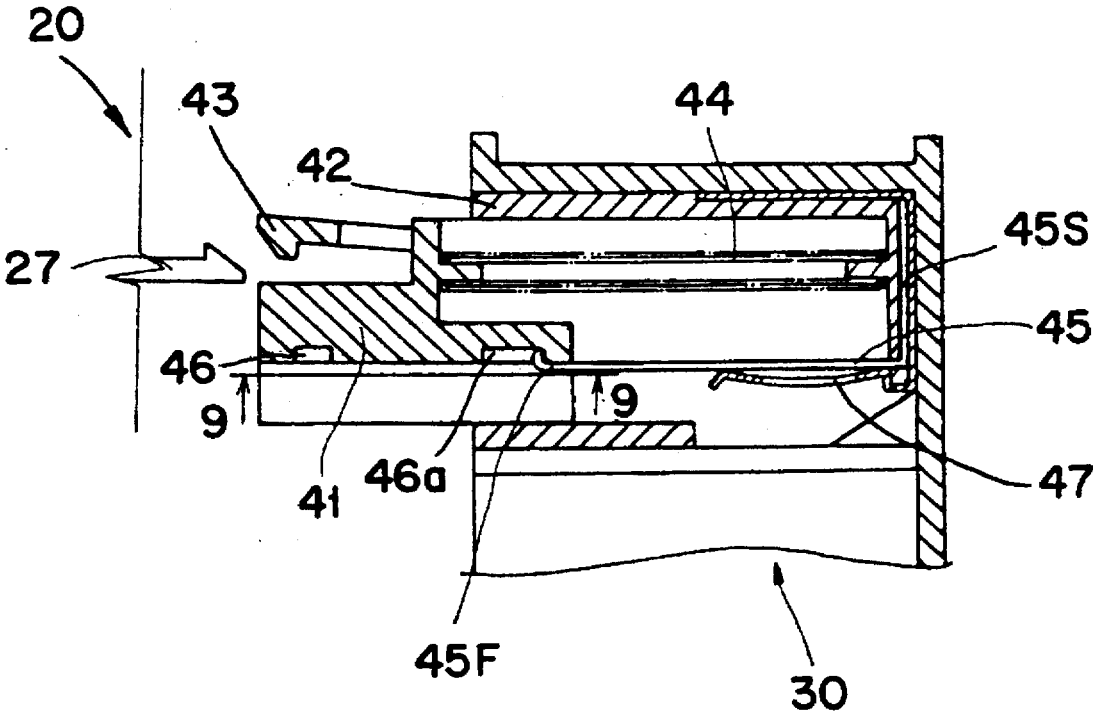
FIG. 7 is an enlarged cross sectional view for illustrating the released state of the locking means.

The catch member 41 has a resilient hook 43 for catching the hook 27, when the hook 27 is retractably inserted into a housed position within the catch housing 42. The resilient hook 43 is pressed downward by the ceiling 42G of the catch housing 42 to catch the hook 27 upon the insertion of the catch member 41 into the catch housing 42. The hook 43 recovers the original position by its resilient force to release the hook 27 upon the retraction of the catch member out of the catch housing 42, as shown in FIGS. 6 and 7. Mounted between the catch member 41 and the housing 42 is a compression spring 44, which is compressed upon the insertion of the catch member 41 into the catch housing, as shown in FIG. 6. Upon releasing the catch member 41, the compression spring 44 resiliently recuperates for the catch member 41 to automatically project forwards to a projecting position, as shown in FIG. 7.

Figure 10:
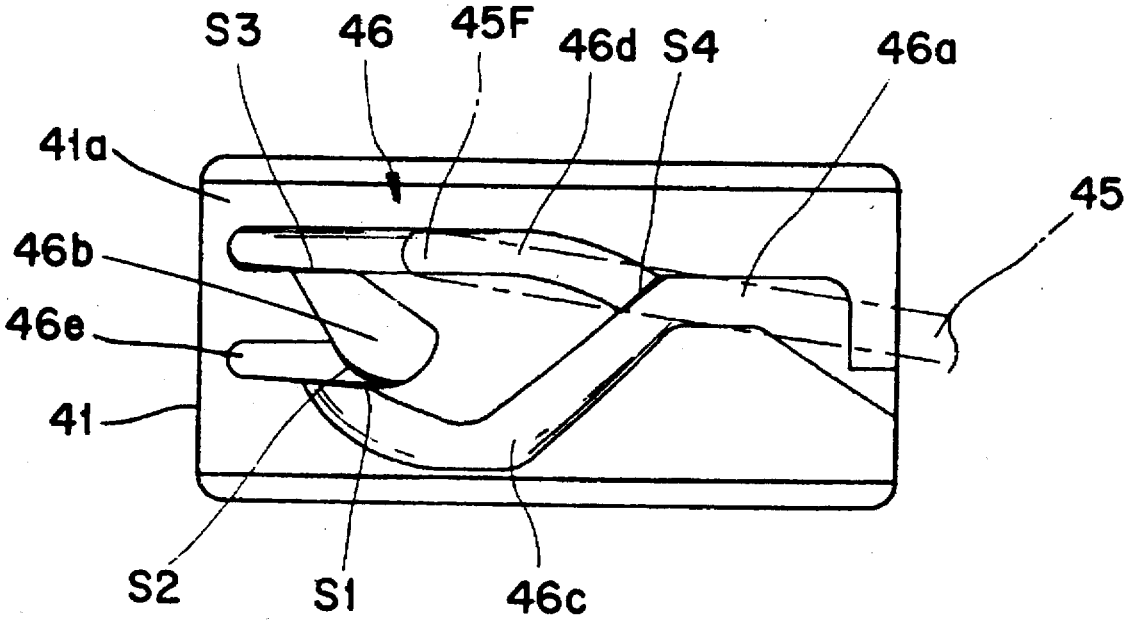
FIG. 10 is a cross sectional view for illustrating the movement of the locking pin from the position of FIG. 8 to the position of FIG. 9.
Figure 11:
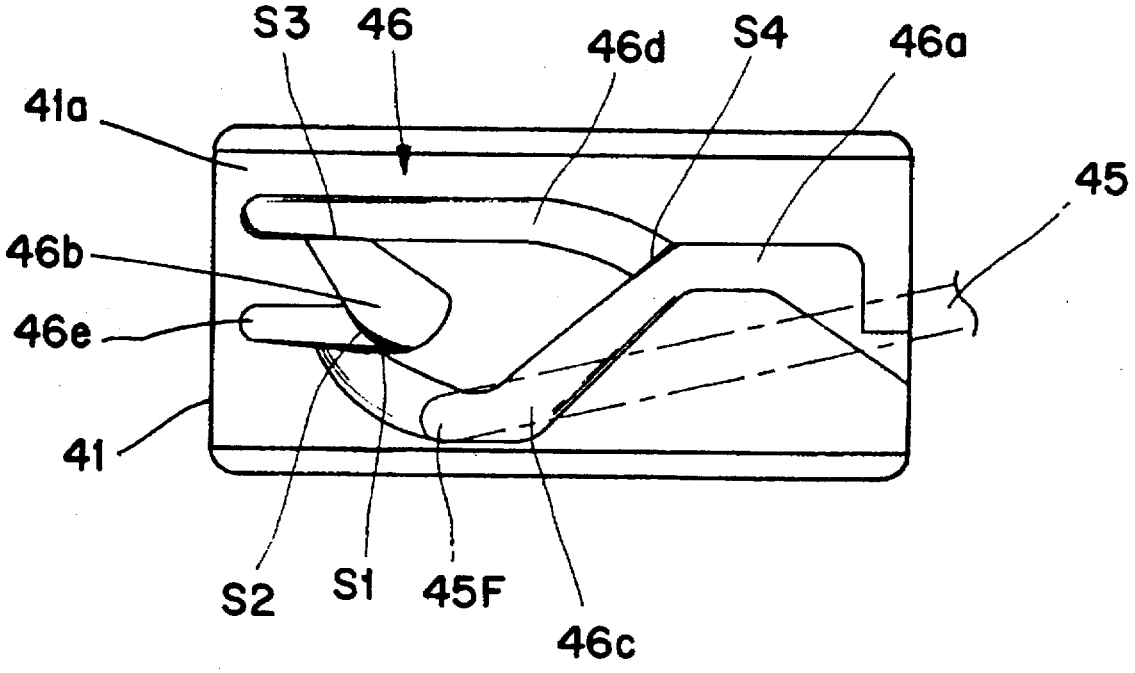
FIG. 11 is a view similar to FIG. 10, showing the movement of the locking pin from the position of FIG. 9 to the position of FIG. 8.

A stopping hook 45 is provided in the catch housing 42 in order to keep the catch member 41 inserted into or projected from the catch housing. The stopping hook 45 has a vertical end 45S fixed to the catch housing 42 and another free end 45F holding the catch member 41. The catch member 41 has a guide groove 46 formed at the bottom 41*a* to guide the stopping hook 45. Referring to FIGS. 8 to 11, the guide groove 46 includes a projection catch part 46*a* for catching the free end 45 in a first state of the stopping hook 45 upon the projection of the catch member 41 out of the catch housing 42 as shown in FIGS. 7 and 9, and an insertion catch part 46*b* for catching the free end 45F in second state upon the insertion of the catch member 41 into the catch housing 42 as shown in FIGS. 6 and 8. Additionally included in the guide groove 46 are an insertion guide part 46*c* for guiding the free end 45F of the stopping hook 45 from the projection catch part 46*a* to the insertion catch part 46*b* upon the insertion of the catch member 41 into the catch housing 42 as shown in FIG. 11, and a projection guide part 46*d* for guiding the free end 45F from the insertion catch part 46*b* to the projection catch part 46*a* upon the projection of the catch member 41 out of the catch housing 42 as shown in FIG. 10. The insertion guide part 46*c* is inclined away from the projection catch part 46*a* and offset downward from the insertion catch part 46*b*.

A holding part 46*e* is formed between the insertion guide part 46*c* and the insertion catch part 46*b*, deeper than the former and shallower than the latter. A step or level difference S1 lies between the insertion guide part 46*c* and the holding part 46*e*, a step S2 lies between the holding part 46*e* and the insertion catch part 46*b*, a step S3 lies between the insertion catch part 46*b* and the projection guide part 46*d*, and a step S4 lies between the projection guide part 46*d* and the projection catch part 46*a*. The insertion guide part 46*c* is formed shallower than the holding part 46*e* at the level difference S1, the holding part 46*e* shallower than the insertion catch part 46*b* at the level difference S2, the insertion catch part 46*b* shallower than the projection guide part 46*d* at the level difference S3, and the projection guide part 46*d* shallower than the projection guide part 46*a* at the level difference S4. The insertion guide part 46*c* becomes gradually shallower away from the projection catch part 46*a* with no level difference or step formed between parts 46*a*, 46*c*. The insertion guide part 46*c* and the projection guide part 46*d* are almost symmetrically formed to give a continuous heart shape.

The catch housing 42 has a plate spring 47 for resiliently pushing the stopping hook 45 so as to continuously keep it against the bottom of the guide groove 46 as shown in FIGS. 6 and 7, which cooperates with the level differences to guide the free end 45F in one direction. Namely, as the front end 36 of the inner casing 30 is pushed into the outer casing 20, the free end 45F, as shown by the arrow lines in FIG. 8, starts from the insertion catch part 46*b* and transverses the projection guide part 46*c* to the projection catch part 46*b*.

Figure 5:
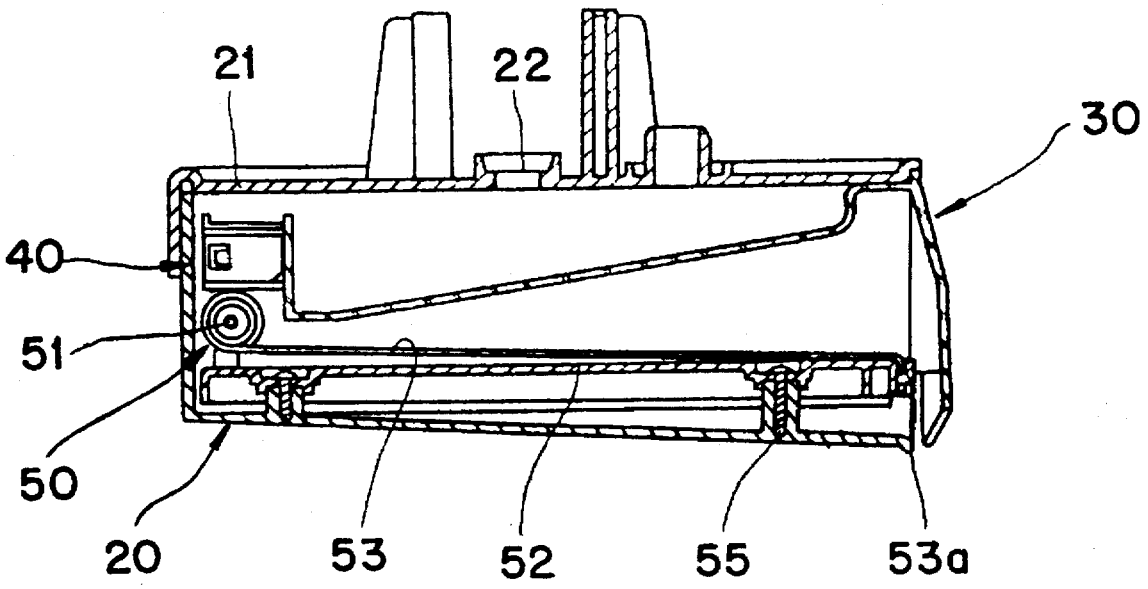
FIG. 5 is a cross sectional side view for illustrating the inner casing of the detergent dissolution device of FIG. 4 inserted into the outer casing.

An automatic retraction mechanism 50 is provided to automatically retract the inner casing 30 from the outer casing 20, which is described with reference to FIGS. 2, 4 and 5. The automatic retraction mechanism 50 includes a roll 51 mounted beneath the rear part of the inner casing 30, a guide member 52 extended from the front end to the rear end of the bottom of the outer casing 20 to guide the roll 51, and a plate spring 53 wound around the roll 51. The roll 51 is shaped like a yarn spindle. One end 53*a* of the plate spring 53 is fixedly attached to the front end of the guide member 52, so that the plate spring 53 is unwound when the roll 51 and the inner casing 20 move into the outer casing 30. In this state, the plate spring 53 is spread on the guide member 52 as shown in FIG. 5. Upon releasing, the plate spring resiliently recuperates to push the inner casing 30 forwards, i.e, to the right in FIG. 4. The guide member 52 is fixedly mounted on the bottom of the outer casing 20 by means of screws 55 as shown in FIG. 4.

Figure 12:
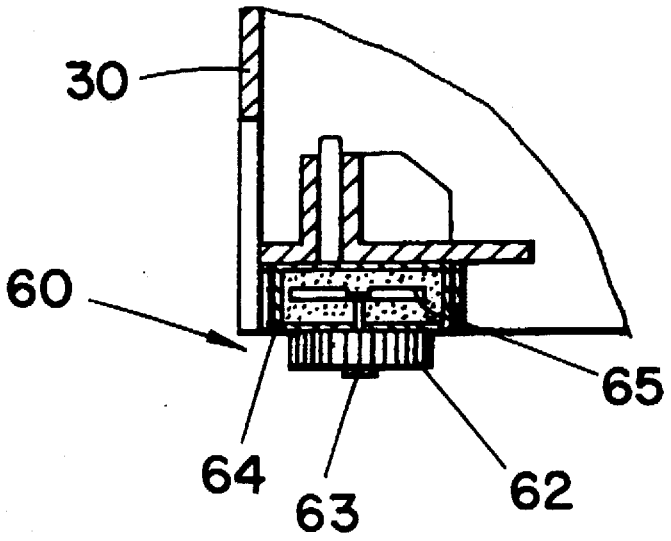
FIG. 12 is an enlarged cross sectional view for illustrating a speed reducing means indicated by circle "B" in FIG. 3.

Referring to FIG. 12, there is provided a speed reducing mechanism 60 to reduce the retracting speed of the inner casing 30. Upon being released from the outer casing 20, the inner casing 30 will be abruptly retracted by the resilient recuperative force of the plate spring 53. The speed reducing mechanism 60 is to reduce the retraction speed of the inner casing, and includes a rack 61 provided at one side of the guide member 52 as shown in FIG. 3, a gear wheel 62 mounted beneath the rear end of the inner casing 30 to engage with the rack 61, a rotating shaft 63 with one end connected to the gear wheel 62, and an oil reservoir 64 for containing oil to impart a resistance to the other end of the rotating shaft 63. Namely, the other end of the rotating shaft 63 has an impeller 65 having a plurality of blades rotating in the oil to damp the rotational speed of the rotating shaft 63. The rack may be provided separately from the guide member 52.

In operation, when the inner casing 30 is locked in the outer casing 20 as shown in FIGS. 5 and 6, the catch member 41 is disposed within the catch housing 42 to catch the hook 27 of the outer casing 20, and the plate spring 53 is unwound from the roll 51 as shown in FIG. 5. In this case, the free end 45F of the stopping hook 45 is hooked by the insertion catch part **46*b* of the guide groove with the compression spring 44 compressed, as shown in FIGS. 8 and 6**.

In this state, the user pushes inwardly against the front end 36 of the inner casing 30 with a suitable force, whereupon the compression spring 44 is compressed to cause the free end 45F of the stopping hook 45 to move away from the insertion catch part **46*b* into the projection guide part 46*d* as shown in FIG. 10, so that the resilient recuperative force of the compression spring 44 causes the catch member 41 to project out of the catch housing 42 as shown in FIG. 7. When the projecting motion of the catch member 41 is completed, the free end 45F of the stopping hook 45 is positioned in the projection catch part 46*a* as shown in FIG. 9. Meanwhile, as the catch member 41 is retracted from the catch housing 42, the resilient hook 43 of the catch member 41 is released from the hook 27 because the ceiling 42G moves out of the overlying relationship with the hook 43, thus releasing the inner casing 30 from the outer casing 20. Namely, upon releasing the resilient hook 43, the inner casing 30 starts the retracting motion by means of the resiliently recuperative force of the plate spring 53. In this case, the gear wheel 62 mounted on the inner casing 30 rotates engaged with the rack 61, whereupon the impeller 65 attached to the rotating shaft 63 rotates, retarded by the oil of the oil reservoir 64 so as to reduce the retraction speed of the inner casing 30. Then, the cover 33 of the detergent receptacle 31 is automatically opened by the resiliently recuperative force of the torsion spring 35**.

In this state, the detergent or rinse agent is put into the detergent receptacle 31 or rinse receptacle, and then the front end of the inner casing 30 is pressed in order to lock the inner casing in the outer casing 20. Namely, upon pushing the front end 36 of the inner casing 30, the plate spring 53 is unwound from the roll 51, and the rear end of the inner casing 30 reaches the rear end 26 of the outer casing 20. Then, as the catch member 41 enters into the catch housing 42 as shown in FIG. 11, the resilient hook 43 is resiliently pressed by the ceiling 42G of the housing 42 to catch the hook 27 as shown in FIG. 6. Meanwhile, the cover 33 of the detergent receptacle 31 provided in the inner casing 30 is automatically closed by the catch housing 42.

As described above, the inventive detergent dissolution device provides means for facilitating the insertion and retraction of the detergent receptacle 30 characterized in that the roll 51 and plate spring 53 causes the inner casing to be automatically inserted or retracted only by pressing the front end 36 of the inner casing 30. In addition, the cover 33 of the detergent receptacle is automatically opened or closed simultaneously with the retraction or insertion of the detergent receptacle.

What is claimed is:

1. A detergent dissolution apparatus for use in a clothes washing machine, comprising:

an outer casing adapted to be mounted in a clothes washing machine;

an inner casing mounted in the outer casing for sliding movement between an inward inserted position within the outer casing, and an outward retracted position projecting from the outer casing, the inner casing including a detergent receptacle for receiving powdered detergent when the inner casing is in the retracted position, the receptacle arranged to receive a flow of incoming wash water when the inner casing is in the inserted position for enabling the detergent to be dissolved;

the inner and outer casings including a manually releasable locking mechanism for locking the inner casing in the inserted position; and a retraction mechanism for displacing the inner casing outwardly to the retracted position in response to a releasing of the locking mechanism.

2. The apparatus according to claim 1 wherein the locking mechanism is automatically actuated in response to the inner casing being pushed inwardly to the inserted position, and is releasable in response to an inward force applied to the inner casing when the inner casing is in the inserted position.

3. The apparatus according to claim 1 wherein the locking mechanism includes:

a first hook mounted on the outer casing; and a catch member mounted in a recess formed in a body of the inner casing and being slidable between a housed position within the recess, and a projecting position in which the catch member projects from the recess, the catch member including a second hook extending generally toward the first hook and disposed in a non-locking position relative to the first hook when the catch member is disposed in the projecting position, and disposed in a locking position with respect to the first hook when the catch member is disposed in the housed position and the inner casing is in the inserted position.

4. The apparatus according to claim 3 wherein the catch member is biased toward the projecting position, and a stop mechanism is provided having first and second releasable stop states for retaining the catch member in the projecting and housed positions, respectively, the stop mechanism being movable out of each of the first and second states in response to the application of an inward force to the inner casing.

5. The apparatus according to claim 4 wherein the stop mechanism includes a third hook fixed to one of the body and catch member, and a guide groove formed in the other of the body and catch member, a free end of the third hook being disposed in the guide groove, the guide groove guiding the free end for travel between the first and second stop states.

6. The apparatus according to claim 5 further including a spring for biasing the free end into the guide groove.

7. The apparatus according to claim 5 wherein the guide groove includes a projection catch portion for catching the free end when the catch member is in the projecting position, an insertion catch portion for catching the free end when the catch member is in the housed position, an insertion guide portion for guiding the free end from the projection catch portion to the insertion catch portion, and a projection guide portion for guiding the free end from the insertion catch portion to the projection catch portion.

8. The apparatus according to claim 7 wherein the guide groove becomes progressively shallower in a direction of movement of the free end therealong, and includes steps for preventing movement of the free end in the opposite direction.

9. The apparatus according to claim 1 wherein the retraction mechanism comprises a spring.

10. The apparatus according to claim 9 wherein the spring comprises a spring strip having one end wound upon a roll mounted on one of the inner and outer casings and another end affixed to the other of the inner and outer casings, the strip being substantially unwound from the roll when the inner casing is in the inserted position, for storing energy to retract the inner casing to the retracted position.

11. The apparatus according to claim 1, further including a speed damping mechanism for damping a speed of travel of the inner casing between the retracted and inserted positions.

12. The apparatus according to claim 11 wherein the speed damping mechanism comprises a rack mounted on one of the first and second casings, a gear wheel mounted on the other of the first and second casings and engaged with the rack to be rotated in response to relative movement between the inner and outer casings, a shaft having one end fixed for rotation with the gear, and an oil reservoir in which the other end of the shaft is disposed.

13. The apparatus according to claim 1 further including a cover hinged to the inner casing for covering the detergent receptacle, the cover biased to an open position, the cover being closed when the inner casing is in the inserted position and swung open when the inner casing is in the retracted position.

14. A clothes washing machine comprising:

a housing for receiving clothes;

a water supply conduit; and a detergent dissolution apparatus for dissolving powdered detergent, including:

an outer casing mounted in the housing at an upper end thereof, an inner casing mounted in the outer casing for sliding movement between an inward inserted position within the outer casing, and an outward retracted position projecting from the outer casing, the inner casing including a detergent receptacle for receiving powdered detergent when the inner casing is in the retracted position, the receptacle arranged to receive a flow of incoming wash water when the inner casing is in the inserted position for enabling the detergent to be dissolved;

the inner and outer casings including a manually releasable locking mechanism for locking the inner casing in the inserted portion; and a retraction mechanism for displacing the inner casing outwardly to the retracted position in response to a releasing of the locking mechanism.

* * * * *